US006935719B2

(12) United States Patent
Yamada

(10) Patent No.: US 6,935,719 B2
(45) Date of Patent: Aug. 30, 2005

(54) INK JET HEAD MAINTENANCE MECHANISM AND INK JET PRINTER EQUIPPED WITH THE MECHANISM

(75) Inventor: Masayuki Yamada, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/383,046

(22) Filed: Mar. 6, 2003

(65) Prior Publication Data

US 2003/0189616 A1 Oct. 9, 2003

(30) Foreign Application Priority Data

Apr. 3, 2002 (JP) ..... 2002-101231

(51) Int. Cl.[7] ..... B41J 2/165

(52) U.S. Cl. ..... 347/29; 347/33; 347/35; 347/30

(58) Field of Search ..... 347/22–35

(56) References Cited

U.S. PATENT DOCUMENTS 5,701,146 A * 12/1997 Akiyama et al. ..... 347/26
6,036,299 A * 3/2000 Kobayashi et al. ..... 347/30
6,350,012 B1 2/2002 Sarkissian ..... 347/46

FOREIGN PATENT DOCUMENTS

EP 0997286 5/2000
GB 2184066 6/1987

OTHER PUBLICATIONS

Search Report, Jun. 24, 2003, Marc Collins, Appl. # GB 0306594.3.

* cited by examiner

*Primary Examiner*—Shih-Wen Hsieh
(74) *Attorney, Agent, or Firm*—Adams & Wilks

(57) ABSTRACT

An ink jet printer has an ink jet head having nozzles for discharging ink into a recording medium to perform printing, and a cap connectable to the ink jet head to cover the ends of the nozzles. To prevent ink from drying on surfaces of the nozzles, the nozzle ends are covered with the cap after completion of printing, and the interior of the cap is filled with ink a predetermined period of time after covering the nozzle ends with the cap. After the elapse of another predetermined period of time from filling the interior of the cap with ink, the interior of the cap is again filled with ink to replenish ink lost from the cap through evaporation. The interior of the cap is filled with ink when power to the ink jet printer is turned off or when no printing is performed for a fixed period time.

15 Claims, 2 Drawing Sheets

INK JET HEAD MAINTENANCE MECHANISM AND INK JET PRINTER EQUIPPED WITH THE MECHANISM

BACKGROUND OF THE INVENTION

1. Field of the Invention

The present invention has been made in view of the above problem in the prior art. It is therefore an object of the present invention to provide an ink jet head maintenance mechanism which does not involve ink dropout even when an ink of the above-described nature is used and the ink jet head is left unused for a long period of time, making it possible to perform satisfactory printing.

2. Description of the Related Art

In a conventional ink jet head maintenance mechanism, a nozzle surface of the ink jet head is capped in order to restrain drying of the nozzle surface after completion of printing. When the ink jet head has been in a standby condition for a long period of time or when the ink jet head has been left unused for a long period of time with the power source off, a cleaning operation according to the standby time is performed to clean the nozzle surface and the interior of the nozzle when starting printing again.

However, in an ink jet printer using a quick-drying ink a solvent of which is an organic solvent or the like, even if the nozzle surface of the ink jet head is capped for protection, a very small quantity of ink around the nozzles is dried when the ink jet head is kept in a standby condition for a long period time or it is left unused for a long time with the power source off. According to that, pigment, a resin layer, etc. adhere to the interior and periphery of the nozzles, and then some of the nozzles will be left clogged even after cleaning is performed, resulting in a problem of a so-called defective discharge in which ink cannot be discharged at the time of printing.

SUMMARY OF THE INVENTION

The present invention has been made in view of the above problem in the prior art. It is therefore an object of the present invention to provide an ink jet head maintenance mechanism which does not involve nozzle dropout even when an ink of the above-described nature is used and the ink jet head is left unused for a long period of time, making it possible to perform satisfactory printing.

To achieve the above object, in accordance with the present invention, there are provided an ink jet head, a cap formed of an elastic material and adapted to seal the nozzle surface of the ink jet head, and a timer, wherein the interior of the cap is filled with ink when a fixed period of time has elapsed after completion of printing, the ink jet head being left in a standby state with the cap completely filled with ink. Further, when a predetermined period of time has elapsed from the standby state, the cap is filled with ink again, always keeping the cap completely filled with ink. Furthermore, for transfer purposes, there is provided a means for selecting between a standby state in which the interior of the cap is completely filled with ink when the power is off and a standby state in which the ink in the cap is all sucked out after completion of printing.

In accordance with the present invention, the nozzle surface of the ink jet head is always filled with ink during standby, so that the interior and periphery of the nozzles are not dried, making it possible to perform satisfactory printing without involving ink dropout from the nozzles even if the ink jet head is left unused for a long period of time.

BRIEF DESCRIPTION OF THE DRAWINGS

For a better understanding of the present invention, reference is made to the following detailed description to be read in conjunction with the accompanying drawings, in which.

DETAILED DESCRIPTION OF THE PREFERRED EMBODIMENT

An embodiment of the present invention will be described with reference to the accompanying drawings.

Figure 1:
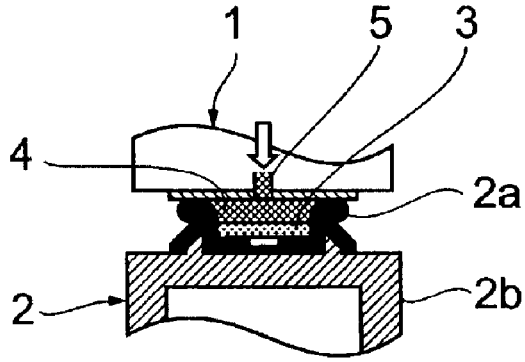
FIG. 1 is an explanatory diagram showing the general construction of the ink jet head maintenance mechanism of the present invention.

FIG. 1 is an explanatory view of the general construction of an ink jet head maintenance mechanism according to the present invention, showing how the nozzle surface of an ink jet head is covered with a cap when the printer is at rest and at so-called completion of printing.

The ink jet printer head maintenance mechanism and, in particular, the cap mechanism, has the construction as shown in FIG. 1. That is, the cap 2 is composed of a cap elastic portion 2*a* formed of an elastic material such as rubber and a cap frame 2*b* provided for the purpose of securing the cap 2 in position and formed of a thermoplastic resin, constituting a mechanism capable of vertical movement. An absorbing body 3 is provided inside the cap 2. When the printer is at rest, the nozzle surface of the ink jet printer head 1 having a large number of nozzles 5 through which ink is discharged is sealed up by the cap 2 moved upward for the purpose of preventing drying of the nozzle surface and protecting the surface from dust or the like.

Figure 2:
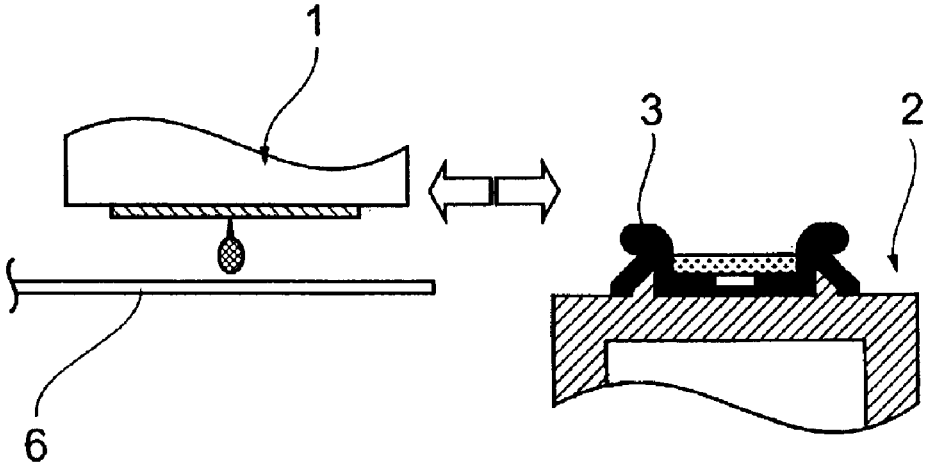
FIG. 2 is an explanatory diagram showing the state in which the ink jet printer head 1 is separated from the cap.

Next, a series of operations conducted at the printing start in order to separate the sealing cap 2 from the thus sealed ink jet printer head 1 to perform printing will be described. FIG. 2 is an explanatory diagram showing the state in which the ink jet printer head 1 is conducting printing, that is, the state in which the ink jet printer head 1 is separated from the cap. When staring printing, the cap 2 is first moved downwards to be separated from the head 1. When the cap 2 has been separated, the head 1 is capable of reciprocating operation. The head 1 performs scanning over a medium 6, and discharges ink on the basis of printing data supplied from a personal computer or the like to form an image on the medium 6. At this time, if printing is performed for a long period of time, the meniscus of the nozzles 5 is likely to be destroyed to cause defective ink discharge. The meniscus is generally restored to the former state by cleaning.

Usually, when the interior of the cap 2 is completely filled with ink at the start of printing by the head 1, surplus ink adheres to the nozzle surface to cause defective discharge, or surplus ink drips onto a medium 6 during scanning with the head 1, so that ink 4 in the cap 2 is all sucked out. Then, after printing has been completed, the cap 2 moves upwards again to cover the ends of the nozzles and seal the nozzle surface of the head 1.

In the case of an ink jet printer using a quick-drying ink using an organic solvent or the like, when the printer is on standby for a long period of time or left unused for a long time with the power off, the solvent of a minute amount of ink around the nozzles 5 is dried even when the nozzle surface of the head 1 is capped for protection, with the result that pigment, a resin layer, etc. adhere to the interior of the nozzles 5. Thus, there is a problem of causing defective discharge. Further, in many cases, such defective discharge cannot be overcome even through cleaning. In view of this, in the maintenance mechanism of the present invention, after a predetermined period of time has elapsed after completion of printing, a pump (not shown) is operated to fill the interior of the cap 2 with ink 4, the interior thereof is completely filled with the ink 4, and the head is kept on standby in this state. This will be described in detail below.

Figure 3:
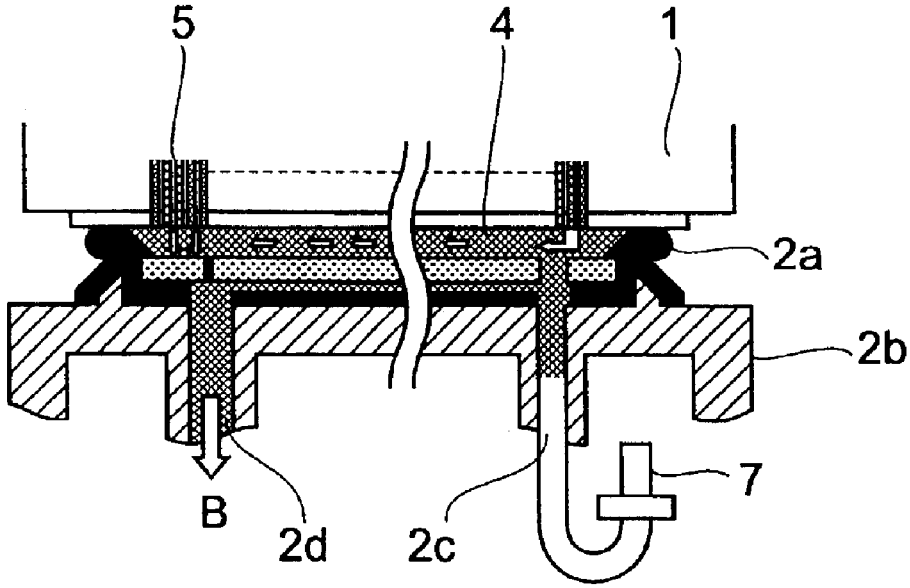
FIG. 3 is an explanatory diagram showing how the interior surrounded by the head nozzle surface and the cap is filled with ink.

FIG. 3 is an explanatory diagram showing how the interior surrounded by the nozzle surface of the head and the cap is filled with ink. Two passages are formed in the cap frame 2*b*: an outside air introduction passage 2*c* and a pump connection passage 2*d*. The pump (not shown) communicates with the pump connection passage 2*d*. When this pump operates, the ink 4 is sucked in the direction indicated by arrow B. At the forward end of the outside air introduction passage 2*c*, there is provided a lid 7 that can be selectively opened/closed to the open air. This lid can be arbitrarily opened/closed by means of an actuator such as a solenoid. When filling the ink 4, the lid 7 is closed to cut off the passage from the interior of the cap 2 to the pump from the exterior. When the pump is operated in this state, the interior of the cap 2 is under negative pressure, and ink is supplied thereto through the nozzles 5 from an ink supply portion (not shown) connected to the head 1. Further, this complete-filling operation is controlled by a control portion (not shown). For example, the time that has elapsed from completion of printing is counted by a timer; when a fixed period of time has elapsed, the interior of the cap 2 is filled with ink 4. In this condition, the head 1 is kept on standby inside the cap 2.

Further, when the standby state has continued for a long period of time, it can happen, especially in the case of an ink jet printer using an ink of a quick-drying solvent, that the ink 4 in the cap 2 is all evaporated before the next printing start. To cope with this, according to the present invention, a built-in timer is provided, and when a predetermined period of time has elapsed, the above-described ink filling operation is performed again so that the cap 2 is completely filled with ink 4 all the time. Note that the control of the ink re-filling operation can be easily executed by a control program as in the case of the above-described control from the control portion (not shown).

Further, when the power source is turned off and the printer is transferred to some other place, if the cap 2 is filled with ink 4, it can disadvantageously happen that the ink 4 overflows the cap during the transfer. In view of this, according to the present invention, as described above, not only is it possible to keep the head on standby with the interior of the cap 2 completely filled with ink 4, but also to keep the head on standby with the ink 4 in the cap 2 all sucked out after completion of printing to avoid the above problem when the power source is turned off and the printer is transferred to some other place. This will be described below.

Figure 4:
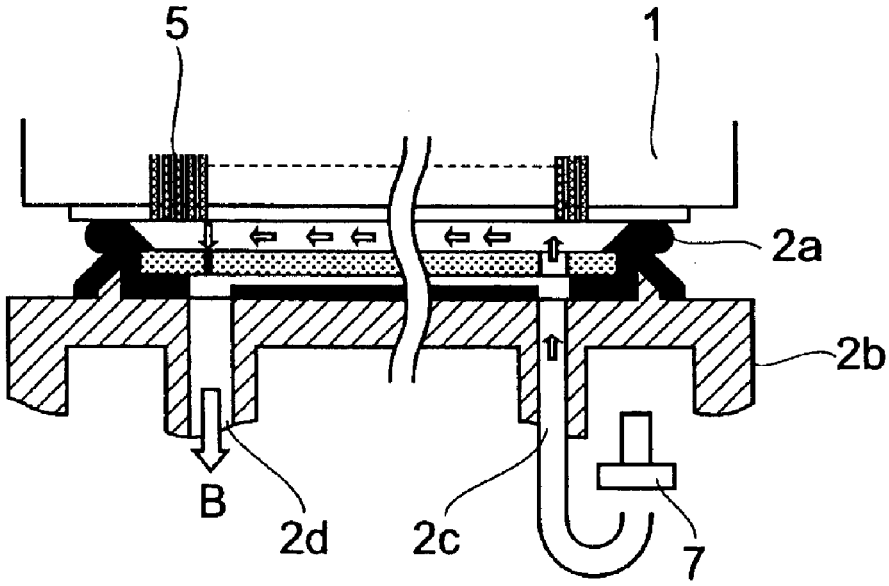
FIG. 4 is an explanatory diagram showing how the ink filling the interior surrounded by the head nozzle surface and the cap is sucked.

FIG. 4 is an explanatory diagram illustrating how the ink completely filling the interior surrounded by the head nozzle surface and the cap is withdrawn. As described above, provided at the forward end of the outside air introduction passage 2*c* is the lid 7 which can be arbitrarily opened/closed by an actuator such as a solenoid and which selectively allows opening/closing to the open air. Thus, when, for example, the power source is turned of f and the printer is to be transferred to some other place, the opening of the lid 7 is selected, making it possible to such the ink with the lid 7 being opened. That is, when the lid 7 is opened, the passage 2*c*, 2*d* from the interior of the cap 2 to the pump is opened to the atmospheric air to attain the atmospheric pressure. When in this condition the pump (not shown) is operated, the ink inside the cap 2 is sucked by the pump and withdrawn from inside the cap 2. In this process, due to the static pressure in the nozzles 5, the ink in the nozzles 5 of the head 1 is not sucked out and only the ink in the cap 2 is sucked and removed by the pump. By performing this sucking or ink withdrawal operation, it is possible to prevent, for example, overflowing of ink during transfer while retaining the meniscus formed in the nozzles 1, thus realizing printer transfer involving no overflowing of ink. Further, by this sucking or ink withdrawal operation, it is also possible to clean the head 1, thus also providing restoration functions, such as meniscus restoration and prevention of defective discharge. This is basic to the cleaning operation in an ink jet printer.

In the maintenance mechanism of the present invention, when the standby state in which the ink in the cap 2 is all sucked out and removed is selected, the above-described sucking operation is performed to suck out and remove the ink from inside the cap 2. The selection means for selecting between the standby state in which the cap is filled with ink and the standby state in which the ink in the cap is sucked out and removed from the cap, can be realized by a well-known switching control technique. Further, the means for operating from outside for selection may be realized, for example, through a combination of key switches of the printer. In the case in which a display panel is provided and an intelligent As described above, by using the ink jet head maintenance mechanism of the present invention, it is possible to perform satisfactory printing involving no dropout of ink from the nozzle even in the case of an ink jet printer using a quick-drying ink solvent of which is an organic solvent or the like or an ink jet printer which has been left unused for a long period of time.

What is claimed is:

1. An ink jet head maintenance mechanism comprising:

an ink jet head for performing printing by discharging ink through nozzles onto a recording medium, and a cap sealingly connectable to a nozzle surface of the nozzles of the ink jet head after completion of printing, wherein after printing has been completed and the nozzle surface of the ink jet head has been sealed with the cap, when a predetermined period of time has elapsed, the interior of the cap is filled with ink such that the nozzle surface is sealed with the cap filled with ink, and wherein when a predetermined period of time has further elapsed after filling the cap with ink, the cap is filled with ink again such that ink is always maintained in the interior of the cap.

2. An ink jet head maintenance mechanism according to claim 1; wherein the cap has an opening/closing valve communicating with the atmosphere, and filling the cap with ink is performed through an opening/closing operation of the opening/closing valve.

3. An ink jet head maintenance mechanism according to claim 2; wherein the opening/closing valve is opened/closed by driving an actuator in response to an input operation from outside.

4. An ink jet printer comprising: an ink jet head maintenance mechanism according to claim 3; wherein the ink jet head performs printing by discharging ink onto a recording medium on the basis of printing data to print characters or images on the recording medium.

5. An ink jet printer comprising: an ink jet head maintenance mechanism according to claim 2; wherein the ink jet head performs printing by discharging ink onto a recording medium on the basis of printing data to print characters or images on the recording medium.

6. An ink jet head maintenance mechanism according to claim 1; wherein ink contained within the interior of the cap is sucked through an opening/closing operation of an opening/closing valve to discharge the ink out of the cap.

7. An ink jet printer comprising: an ink jet head maintenance mechanism according to claim 6; wherein the ink jet head performs printing by discharging ink onto a recording medium on the basis of the printing data to print characters or images on the recording medium.

8. An ink jet printer comprising: an ink jet head maintenance mechanism according to claim 1; wherein the ink jet head performs printing by discharging ink onto a recording medium on the basis of printing data to print characters or images on the recording medium.

9. In an ink jet printer having an ink jet head having nozzles for discharging ink onto a recording medium to perform printing and a cap connectable to the ink jet head to cover the ends of the nozzles, a method of preventing ink from drying on surfaces of the nozzles comprising the steps:

covering the nozzle ends with the cap after completion of printing;

filling the interior of the cap with ink a predetermined period of time after covering the nozzle ends with the cap; and after the elapse of another predetermined period of time from filling the interior of the cap with ink, again filling the interior of the cap with ink to replenish ink lost from the interior of the cap through evaporation.

10. In an ink jet printer according to claim 9; wherein the step of covering the nozzle ends with the cap is carried out when power to the ink jet printer is turned off or when no printing is performed for a fixed period time.

11. In an ink jet printer according to claim 9; wherein the step of covering the nozzle ends with the cap is carried out when power to the ink jet printer is turned off.

12. In an ink jet printer according to claim 9; wherein the step of covering the nozzle ends with the cap is carried out when no printing is performed for a fixed period of time.

13. In an ink jet printer according to claim 9; wherein the steps of filling and again filling the interior of the cap with ink are carried out by flowing ink through a passage formed in the cap.

14. In an ink jet printer according to claim 9; wherein the ink is a quick-drying ink.

15. In an ink jet printer according to claim 9; wherein the steps of filling and again filling the interior of the cap with ink are carried out after predetermined periods of time counted by a timer built into the ink jet printer.

* * * * *